United States Patent [19]

Anderson

[11] 4,228,619

[45] Oct. 21, 1980

[54] VIBRATORY FINISHING MACHINE

[75] Inventor: Gordon H. Anderson, Albert Lea, Minn.

[73] Assignee: King-Seeley Thermos Co., Prospect Heights, Ill.

[21] Appl. No.: 964,187

[22] Filed: Nov. 28, 1978

Related U.S. Application Data

[63] Continuation of Ser. No. 833,001, Sep. 14, 1977, abandoned.

[51] Int. Cl.[3] ..... B24B 31/00

[52] U.S. Cl. ..... 51/163.1

[58] Field of Search ..... 51/163, 7

[56] References Cited

U.S. PATENT DOCUMENTS

| | | | |
|---|---|---|---|
| 2,840,923 | 7/1958 | Behrens | 51/163.1 X |
| 3,134,207 | 5/1964 | Ferrara | 51/163.1 |
| 3,341,978 | 9/1967 | Carstens | 51/163.1 |
| 3,624,970 | 12/1971 | Balz | 51/163.1 |
| 3,680,266 | 8/1972 | Shiplou | 51/163.1 |

*Primary Examiner*—Harold D. Whitehead

*Attorney, Agent, or Firm*—Harness, Dickey & Pierce

[57] ABSTRACT

A vibratory finishing machine comprising a tub-like container having a substantially open upper side and defining a peripheral rim portion, the container adapted to receive workpieces and finishing media, means for imparting vibratory movement to the container and thereby causing the media to perform a finishing operation on the workpieces, a support structure for the container and including a base adapted to rest upon a support surface, the support structure also including a bin support section projecting upwardly from the base to a position subjacent the rim portion of the container, spring connected between the uppermost part of the support section and the container rim for resiliently supporting the container thereon, a vibratory mechanism including an eccentrically weighted vibratory shaft arranged substantially parallel to the longitudinal axis of the container at a position located below the container and offset asymmetrically from the center of the container.

5 Claims, 5 Drawing Figures

Fig. 1.
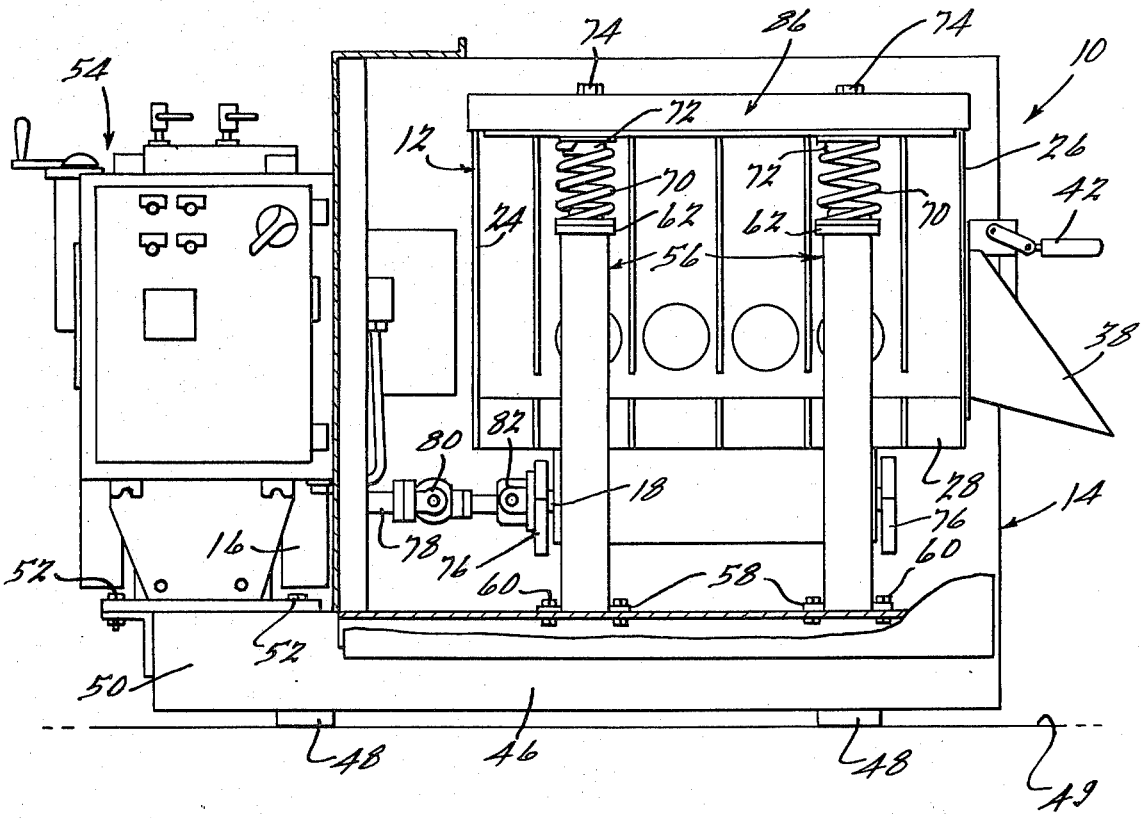
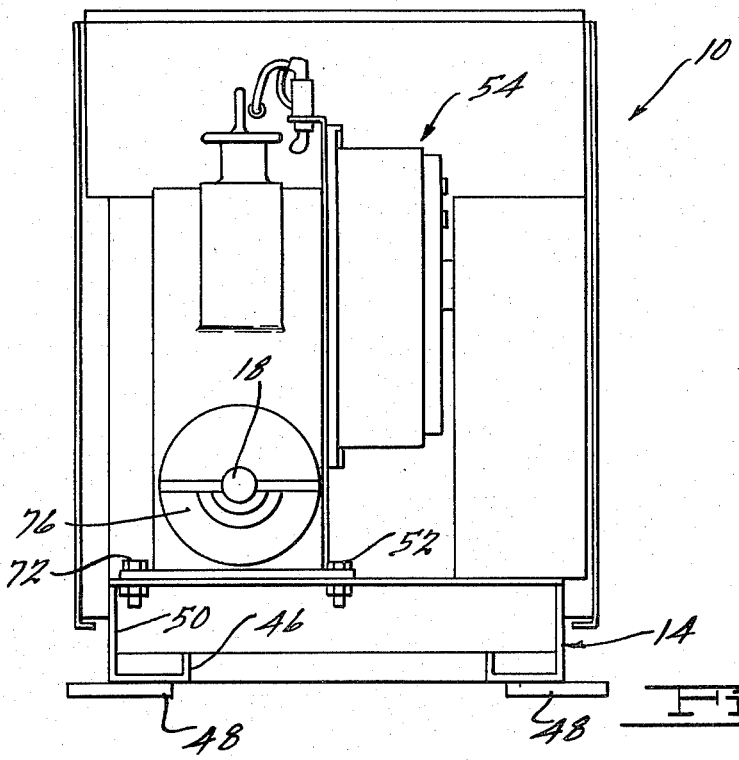
Fig. 2.

VIBRATORY FINISHING MACHINE

This is a continuation of application Ser. No. 833,001, filed Sept. 14, 1977 now abandoned.

BACKGROUND AND SUMMARY OF THE INVENTION

The present invention is generally directed toward vibratory finishing machines and more particularly, toward a new and improved finishing machine of the type adapted to be used with steel finishing media.

One of the objectionable characteristics of utilizing steel finishing media in vibratory finishing machines is the difficulty in obtaining the desired "flow" of the media. One of the significant reasons for such difficulty resides in the need for utilizing certain chemical compound additives in the finishing operation which have been found to severely hinder or preclude media flow, which in turn results in precluding effective workpiece finishing. Although satisfactory media flow has been obtainable in the past through the use of large counterweights, such an approach has not been feasible with steel media because of the high magnitude of media-workpiece impact which prevents obtaining the fine finish desired for the type of parts that are traditionally processed with steel finishing media.

The present invention provides a new and improved vibratory finishing machine which has been found to provide highly improved media flow at low magnitudes of media-workpiece impact, thereby obviating the various objectionable characteristics of the prior art machines. The finishing machine of the present invention utilizes a unique combination of features, including the provision of support springs for the finishing tub at a position adjacent the peripheral rim or edge of the tub, the use of an asymmetrically located weighted vibratory shaft and the additional use of an asymmetrically located tub weight that is preferably located on the opposite side of the longitudinal axis of the tub from the vibratory shaft, as will hereinafter be described in detail.

It is accordingly a general object of the present invention to provide a new and improved vibratory finishing machine.

It is a more particular object of the present invention to provide a new and improved vibratory finishing machine that is particularly, although not necessarily, adapted for use with steel finishing media and is intended to provide improved finishing action, as compared to prior known finishing machines.

It is another object of the present invention to provide a new and improved finishing machine of the above described type which incorporates a plurality of suspension or support springs that are located above the center of gravity of the finishing tub, and specifically are located directly beneath the peripheral flange or rim of the tub.

It is still another object of the present invention to provide a new and improved finishing machine that is provided with an asymmetrically located weighted vibratory shaft.

It is a further object of the present invention to provide a new and improved vibratory finishing machine that may be provided with an asymmetrically located tub weight which is preferably located on the laterally opposite side of the longitudinal tub axis from the weighted vibratory shaft.

It is still a further object of the present invention to provide a new and improved vibratory finishing machine wherein improved media flow is achieved in the range of low media impact with the media workpieces, whereby to improve the operational performance of the machine of the present invention.

Other objects and advantages of the present invention will become apparent from the following detailed description taken in conjunction with the accompanying drawings.

BRIEF DESCRIPTION OF THE DRAWINGS

FIG. 1 is a side elevational view of a vibratory finishing machine in accordance with the principles of the present invention.

FIG. 2 is an end elevational view of the left end of the machine shown in FIG. 1;

DETAILED DESCRIPTION OF A PREFERRED EMBODIMENT

Figure 3:
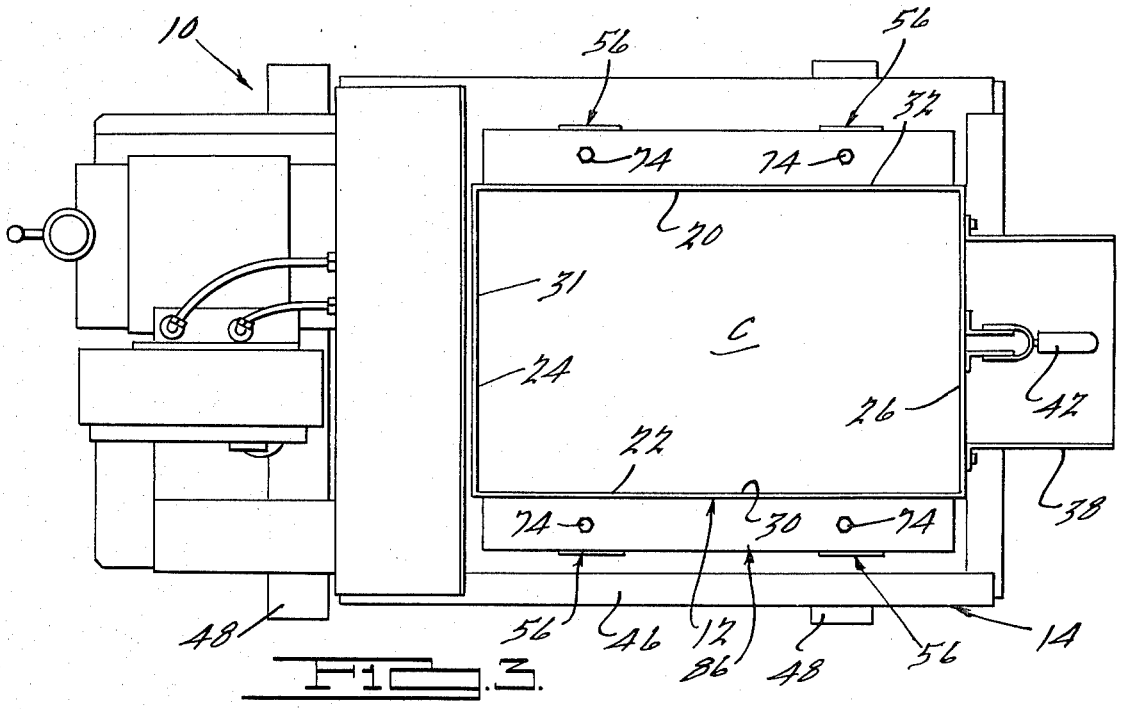
FIG. 3 is a top elevational view of the finishing machine shown in FIGS. 1 and 2.

Referring now in detail to the drawings and in particular to FIG. 1 thereof, a vibratory finishing machine 10, in accordance with one preferred embodiment of the present invention, is shown as comprising a tub-like container 12 that defines an open upper sided finishing chamber C adapted to receive a quantity charge of finishing media and a plurality of workpieces upon which a finishing operation is to be performed. The container 12 is operatively mounted upon a support structure, generally designated by the numeral 14, which is provided with drive means in the form of a motor 16 that is drivingly connected to an eccentrically weighted shaft 18, rotation of which shaft 18 imparts vibratory movement to the container 12 so that the aforementioned finishing operation may occur.

As best seen in FIG. 3, the container 12 comprises laterally spaced parallel, generally vertically disposed side sections 20 and 22 between which longitudinally spaced, vertically extending end sections 24 and 26 are located. The lower end of the container 12 is closed by a generally arcuate-shaped bottom section 28, with the top or upper end of the container 12 being open so as to provide an access opening 30 for receiving the aforementioned finishing media and workpieces. Typically, the container 12 would be provided with an interior liner 31, fabricated, for example, of a material such as disclosed in U.S. Pat. No. 3,707,058.

The upper end of the container 12 includes a peripheral rim portion 32 which is formed with a pair of longitudinally extending laterally outwardly projecting flanges 34 and 36 which are affixed to the upper terminal edges of the tub side sections 20 and 22. The end section 26 of the container 12 is provided with a discharge chute 38 having a closure door 40 which may be selectively moved to an open position to permit discharge of the finishing media and workpieces upon completion of a finishing cycle. Typically, the closure door 40 would be provided with suitable locking or latching means 42 in a manner well known in the art.

The support structure 14 includes a generally horizontally disposed base section 46 having lower support legs 48 adapted to rest or bear upon a suitable support surface 49, as seen in FIG. 1. The base section 46 includes a longitudinally outwardly extending end section 50 upon which the aforementioned drive means 16 is secured, for example, by suitable screws, bolts or the like 52. Located directly above the drive means or motor 16 are conventional operating controls, generally designated by the numeral 54, by which the operational timing cycle may be controlled, as well as the magnitude of the vibrational movement of the container 12, in a manner well known in the art.

Figure 4:
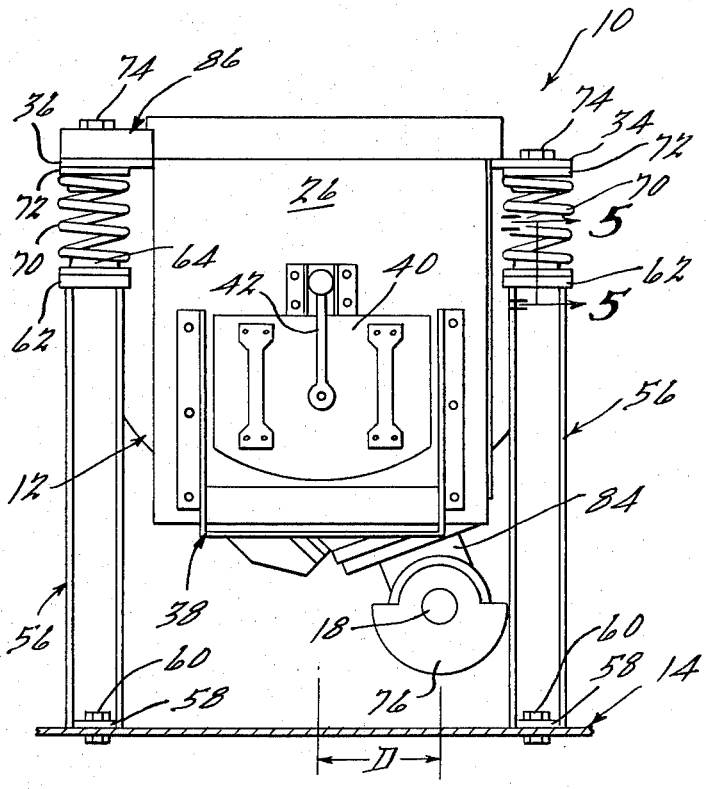
FIG. 4 is an end elevational view of the right end of the finishing machine shown in FIG. 1.
Figure 5:
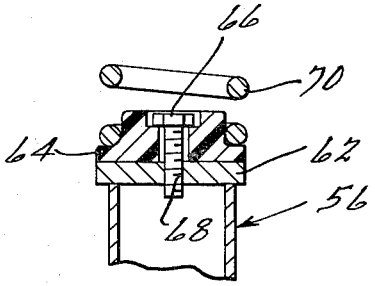
FIG. 5 is an enlarged fragmentary cross-sectional view taken substantially along the line 5—5 of FIG. 4.

In accordance with some of the principles of the present invention, the support structure 14 includes a plurality of four vertically disposed support columns, generally designated 56, which are arranged two on each side of the container 12, as best seen in FIGS. 1 and 4. The support columns 16 on each side of the container 12 are generally longitudinally aligned with one another, and the pairs of columns 56 at the opposite longitudinal ends of the container 12 are generally laterally aligned with one another. The lower ends of the columns 56 are provided with mounting flanges 58 which are adapted to be secured by suitable screws, bolts, welding, etc., 60 to the base section 46, whereby to rigidly secure the columns 56 to the support structure 14. As best seen in FIG. 5, the upper end of each of the support columns 56 is provided with an upper end member 62 upon which is mounted a lower spring seat 64. The spring seats 64 may be fabricated of an elastomeric material and be secured to the upper end members 62 by suitable bolts 66 that extend downwardly through the seats 64 and are threadably received within central threaded openings 68 of the members 62. The spring seats 64 serve to operatively support the lower ends of a plurality of helical coil springs 70 which extend vertically upwardly from the seats 64 to a position directly below the flanges 34, 36. The upper ends of the springs 70 are engaged with suitable upper spring seats 72 which are secured to the underside of the flanges 34, 36 by suitable screws, bolts or the like 74.

In accordance with another feature of the present invention, the eccentrically weighted shaft 18 is provided with a plurality of eccentric weights, generally designated by the numeral 76, and which, when rotated via a drive shaft 78 connecting the shaft 18 with the drive means 16 and suitable couplings 80, 82, serves to impart vibratory movement to the container 12 and hence to the finishing media and workpieces contained within the chamber C thereof. Suitable connecting means or structure, as designated at 84 in FIG. 4, operatively connects the shaft 18 to the underside of the container 12, in a manner well known in the art. As best seen in FIG. 4, the longitudinal axis of the shaft 18 is offset laterally a distance D from the longitudinal center line of the container 12. The magnitude of the offset distance D may be varied in accordance with the desired vibratory dynamics and one satisfactory magnitude of the offset D has been found to be equal to approximately one-half the lateral distance between the axis of the opposed pairs of coil springs 70. Of course, various other offset distances are intended to come within the scope of the present invention.

In accordance with another feature of the present invention, the flange 36 is provided with counterweight means which is representatively designated by the numeral 86. The weight 86 is preferably substantially coextensive of the longitudinal length of the container 12 and is secured to the upper side of the flange 36, for example, by the aforementioned screws, bolts 74 that are utilized to connect the upper spring seats 72 to the flange 36. The cross-sectional shape of the counterweight 86 may be variable, although in a preferred construction of the present invention, the counterweight is of uniform cross-sectional shape along its entire length and is located on the flange of the container 12 that is disposed on the opposite side of the longitudinal center line of the container 12 from the shaft 18. In other words, in a preferred construction of the present invention, the shaft 18 is offset laterally in one direction from the longitudinal center line of the container 12, while the counterweight 86 is located on the container flange disposed on the opposite side of said center line.

The aforegoing combination of elements pursuant to the present invention, provides a vibratory finishing machine which exhibits highly improved media flow, particularly at low magnitudes of media-workpiece impact, whereby to particularly adapt the present invention for use with steel media without the requirement of large amounts of chemical compound additives that have been necessitated in the past. Of course, the present invention will find wide and varied use and the various alternative types of media of the present invention is not intended to be solely limited in its application to steel finishing media. By virtue of the fact that the vibratory finishing machine of the present invention is of a relatively straightforward design which incorporates a number of components of similar type finishing machines already in existence, the improved features of the present invention may be obtained without incurring significant additional tooling expenses. Additionally, by virtue of the fact that the counterweight 86 may be varied in size in accordance with the desired media flow dynamics, the present invention will find universality of application.

While it will be apparent that the preferred embodiment of the invention disclosed is well calculated to fulfill the objects above stated, it will be appreciated that the invention is susceptible to modification, variation and change without departing from the proper scope or fair meaning of the subjoined claims.

I claim:

1. A vibratory finishing machine comprising:

a tub-like container having a substantially open upper side and defining a peripheral rim portion, said container adapted to receive workpieces and a finishing media, means for imparting vibratory movement to said container and thereby causing said media to perform a finishing operation on said workpieces, said last mentioned means including, a support structure for said container and including a base adapted to rest upon a support surface, said support structure also including a container support section projecting upwardly from said base to a position subjacent said rim portion of said container, spring means connected between the uppermost part of said support section and said container rim for resiliently supporting said container thereon, a vibratory mechanism including, an eccentrically weighted vibratory shaft, said shaft extending substantially parallel to the longitudinal axis of said container at a position located below said container and offset asymmetrically from the center of said container, and weight means on said container and disposed asymmetrically of said centerline thereof in the direction opposite from said vibratory shaft.

2. The invention as set forth in claim 1 which includes power operated means for rotating said asymmetrically weighted shaft.

3. The invention as set forth in claim 1 wherein said spring means is located above the center of gravity of said container.

4. The invention as set forth in claim 1 wherein said weight means comprises a weighted element arranged generally parallel to the longitudinal axis of said container.

5. The invention as set forth in claim 4 wherein said weighted element is arranged generally parallel to the longitudinal axis of said shaft.

* * * * *